United States Patent [19]

Cawse et al.

[11] Patent Number: 4,902,612

[45] Date of Patent: Feb. 20, 1990

[54] PHOTOGRAPHIC COATING SOLUTIONS

[76] Inventors: John L. Cawse, Old Barn Cottage, Rainow, Macclesfield, Cheshire SK10 5TY; David Rowland, 4 Broom Field Close, Chelford, Macclesfield, Cheshire, both of England

[21] Appl. No.: 310,593

[22] Filed: Feb. 13, 1989

[30] Foreign Application Priority Data

Feb. 12, 1988 [GB] United Kingdom ..... 8803282

[51] Int. Cl.[4] ..... G03C 1/02

[52] U.S. Cl. ..... 430/628; 430/634; 430/635; 430/935

[58] Field of Search ..... 430/628, 634, 635, 935

[56] References Cited

U.S. PATENT DOCUMENTS 4,391,903 7/1983 Sysak ..... 430/629
4,677,050 6/1987 Yokoyama et al. ..... 430/536

FOREIGN PATENT DOCUMENTS 1030001 5/1966 United Kingdom .
1503043 12/1966 United Kingdom .
1316541 5/1973 United Kingdom .
1333663 10/1973 United Kingdom .

*Primary Examiner*—Paul R. Michl
*Assistant Examiner*—Janet C. Baxter
*Attorney, Agent, or Firm*—Wenderoth, Lind & Ponack

[57] ABSTRACT

Aqueous photographic coating solutions comprising a gelatino silver halide emulsion, a synthetic polymer latex and a compound of the general formula

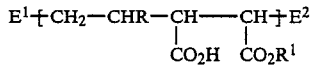

where $E^1$ and $E^2$ represent the end groups of the polymer chain, R is an alkyl group or phenyl, $R^1$ is a polyether moiety, M is a monovalent cation or hydrogen and x is 3 to 200, the ratio of this compound to the synthetic polymer being from 0.1 to 50 of this compound to 100 of the synthetic polymer on a dry solids basis.

7 Claims, No Drawings

PHOTOGRAPHIC COATING SOLUTIONS

This invention relates to aqueous photographic coating solutions and to photographic materials prepared therefrom.

Polymer latices are often used in the photographic emulsion layer of photographic pring material coated on a paper base. The polymer latices serve to improve the dimensional stability of the assembly. That is to say the presence of the polymer latex helps to reduce the effect of variable humidity conditions so reducing curl. Further the presence of the latex reduces the amount of water present in the emulsion coating solution, thus reducing the amount of water required to be removed during the drying of the coated emulsion layer.

However when a latex is present in a silver halide coating solution a stabilizer is required to be present. Often surfactants have been used as stabilisers but many of the surfactants commonly used in emulsion polymerisations for example, alkyl sulphates and sulphonates, and aryl sulphonates, can cause serious photographic defects and can result in the removal of sensitising dye from the silver halide crystal surface or can otherwise affect the sensitometric behaviour of the coated product containing the latex. This has led to surfactants being tried which exhibit minimal sensitometric activity, but very often these surfactants can not provide a sufficient degree of stabilisation for mixtures of latex with the components of the coating solution.

By stability in this sense is meant the tendency of a solution to 'fail' when subjected to high shear forces—such as those found in pumps, filtration systems and narrow orifices, all commonly found in coating machines. The failure of a solution under shear is manifest in the deposition of debris as sticky or gritty particles which ultimately can cause filter blockages and therefore reduce the efficiency of the coating process. Other methods of improving the shear stability of photographic coating solutions which have been tried are the post-addition of extra surfactant to the coating solution or the use of colloid stabilizers. However adding extra surfactant can result in a much increased foaming tendency in the coating solution and is usually deleterious to photographic sensitometry. Many colloid stabilizers which have been proposed to be added to latex to increase shear stability, are not photographically acceptable or cause coagulation when the stabilised latex is mixed with gelatin.

We have found a photographic coating solution comprising a latex which is remarkably stable to shear forces.

Therefore according to the present invention there is provided an aqueous photographic coating solution which comprises a gelatino silver halide emulsion, a synthetic polymer latex and a compound of the general formula I :

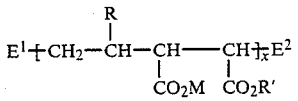

I wherein $E^1$ and $E^2$ represent the end groups of the polymer chain, R is a linear or branched alkyl group chain comprising 6 to 20 carbon atoms or is a phenyl group, R′ is a polyether moiety of the formula

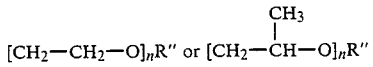

wherein R″ is a hydrogen atom, an alkyl group having 1 to 4 carbon atoms or $CH_3CO$— and n is 2 to 20, M is hydrogen or a monovalent cation, and x is 3 to 200, the ratio (by weight) of the compound of formula I to the synthetic polymer being from 0.1 to 50 of the compound of formula I to 100 of the synthetic polymer on a dry solids basis.

Preferably R is an alkyl group having 10 to 18 carbon atoms.

Preferably R″ is $(CH_2CH_2O)_n CH_3$ and n is 3 to 15.

Preferably x is 5 to 50.

Examples of suitable monovalent cations are sodium, potassium, lithium, ammonium, a quaternary ammonium group or a substituted nitrogen compound for example triethanolamine.

Preferably M is sodium or potassium.

With reference to the E′ and E″ end-groups, as is well-known to anyone experienced in the art, the end-groups of polymer molecules formed by free radical initiation are generally incpaable of determination with any degree of certainty, however it may be expected that at least one of the end-groups may either be an initiator residue or a group formed by disproportionation or chain transfer reactions during the preparation of the polymer of the claimed structure. Initiator residues may generally include those from alkyl or aryl peroxides, azo compounds, peroxydisulphates, peresters and peroxy carbonates, and specific examples may include the following radicals:

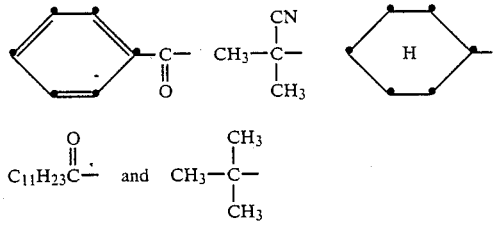

Further examples of commonly used initiators may be found in Polymer Handbook, Second Edition, John Wiley Publishers N.Y., 1975. Editors E.H. Immergut and J. Brandrup, Chapter II.1.

End-groups formed by disproportionations reactions may be saturated or unsaturated units from M or the initiating agent. Examples of such units may be found in Principles of Polymer Chemistry, Cornell U.P., P.J. Flay, p. 111.

The synthetic polymer latex comprises a homopolymer or copolymer of one or more ethylenically unsaturated monomers formed in the presence of one or more surface active agents but in the absence of any of the compound of formula I. If the polymer is formed in the presence of a compound of formula I the latex either tends to coagulate or to be formed as a latex with an excessively large particle size which renders it unacceptable for use in a photographic coating solution.

Particularly suitable synthetic polymers are copolymers which comprise for example an alkyl acrylate, methyl methacrylate and/ or optionally a hydroxyalkyl acrylate or methacrylate and an acid monomer.

Examples of suitable alkyl acrylates are butyl acrylate, hexyl acrylate and ethyl acrylate. Examples of suitable acid monomers are methacrylic acid, acrylic acid, maleic acid and itaconic acid.

Examples of suitable synthetic polymers are given in British Patent Specifications 1316541, 1333663, 1053043 and 1030001. Especially useful polymers as described in these patent specifications include copolymers derived from :

I. a monomer which is an alkyl acrylate or an alkyl methacryalte or a monomer mixture comprising both an alkyl acrylate and an alkyl methacrylate or a monomer mixture comprising either one of the said monomers or the said monomer mixture together with another ethylenically unsaturated monomer, the monomer or monomers being compounds which when homopolymerised yield water insoluble polymers and II. a monomer which is an hydroxy-substituted alkyl acrylate or methacrylate of the general formula $$CH_2{=}C(R)C)_2{-}R{-}OH$$

where R is a hydrogen atom or a methyl group and R' is a straight or branched saturated methylene chain having grom 2 to 6 carbon atoms, the monomer being one which when homopolymerised yields a water-soluble polymer.

The preferred monomer I is butyl acrylate and the preferred monomer II is 2-hydroxypropylmethacrylate.

Polymers derived from

I. a monomer which is an alkyl acrylate or methacrylate or a monomer mixture comprising both an alkyl acrylate and an alkyl methacrylate, and II. a monomer which is an amino alkyl acrylate or methacrylate salt of the general formula $$(CH_2{=}C(R){-}CO_2{-}R{-}NH_2)_nH_nX$$

where R is a hydrogen atom or a methyl group, R is a saturated methylene chain having from 2 to 6 carbon atoms in the chain, n is 1 or 2 and X is a monovalent anion when n is 1 and is a divalent anion when n is 2.

A substantially water-insoluble copolymer of (a) acrylic and/or methacrylic acid and, (b) at least one alkyl acrylate having 4 to 6 carbon atoms in the alkyl radical, the copolymer preferably containing at least 5 mole per cent but preferably not more than 24 mole per cent of the acid constituent.

Specific alkyl acrylates which may be employed are the butyl acrylates, particularly n-butyl acrylate, or tertiary butyl acrylate, n-amyl acrylate and n-hexylacrylate.

The photographic coating solution of the present invention can contain any of the other ingredients commonly found in coating solutions, for example additional surfactants to aid in the coating of the solution and biocides.

The gelatino silver halide emulsion may of course comprise any of the ingredients commonly found in such emulsions depending on the photographic material which is to be prepared, for example dispersions of colour couplers may be present if colour photographic material is to be prepared. Other common ingredients include gelatin hardening agents and humectants.

The silver halide emulsion may contain any of the silver halides used in photographic materials, for example silver iodobromide, silver chlorobromide, and silver chloride.

The photographic coating solution may be applied to any of the many bases used for photographic materials such as cellulose based materials for example cellulose triacete and cellulose acetate-butyrate. Examples of synthetic polymer bases which may be used include biaxially oriented polystyrene, polycarbonate and polyethylene terephthalate. Paper base and polyalkylene laminated paper base are the usual bases for photographic print material.

The photographic coating solution can be coated on any such base by any suitable technique for the application of aqueous coating compositions. For example, it can be coated by spray coating, dip coating, cascade coating, swirl coating, extrusion hopper coating, curtain coating, air knife coating, or other coating techniques. The thickness of the coated layer will depend upon the particular requirements of the photographic assembly.

Typically, the dry weight coverage is in the range from 0.2 to 4 grams per square metre and most usually in the range from 1 to 3 grams per square metre. Drying of the coated layer can be carried out over a wide range of temperatures. For example, temperatures of from 20° C. to 60° C. and preferably from 25° C. to 50° C. generally give satisfactory results.

Many of these coating processes involve subjecting the coating solution to shear forces and the special property of the coating solution of the present invention is not to break down when subjected to such shear forces.

When the photographic coating solution is applied to a polyolefin coated paper support, it is advantageous to treat the polyolefin surface, by a suitable method such as corona discharge, ozone or flame treatment, to render it receptive to the coating composition. The paper which is used to prepare the support can also be tub sized with a solution of a conducting salt which acts an internal antistat.

It is also advantageous to employ paper stock containing at least 3%, and generally from 4 to 8% (by weight), moisture.

When the photographic coating solution is applied to a polyester film support, a subbing layer is advantageously employed to improve the bonding of the coating solution to the support.

Subbing compositions for this purpose are known in the art and include, for example, interpolymers of vinylidene chloride such as vinylidene chloride/acrylonitrile/acrylic acid terpolymers or vinylidene chloride/-methyl acrylate/itaconic acid terpolymers.

It is to be understood that the invention not only includes the photographic coating solution but also photographic material prepared by coating the solution on a base and drying it.

The accompanying Examples will serve to illustrate the invention.

In the Examples for the purposes of demonstrating the effects of different additives on shear stability, the following equipment was used. The solution to be tested was kept in a thermostated container at 37° C., and pumped through a stainless steel gear pump, after which a pressure gauge was attached (reading 0–50 psi), followed by a 13 mm diameter stainless steel mesh filter (200 mesh) and at a further distance of 10cm, a second similar filter (400 mesh).

The pumping speed was set at 2 liters per minute.

Test solutions were prepared by addition of the latex or latex including stabiliser, to a stirred gelatino silver halide emulsion which comprised 10% by weight of gelatin and silver halide.

The solutions were prefiltered under gravity through a 38 um mesh to remove microgel particles and dust etc. The concentration of gelatin in the solution was 10.3 % and the latex 2.9 % on a total solids basis. Solutions were pumped through the system and pressure build-up recorded as a measure of the tendency of the solution to fail under shear. Runs were repeated three times with fresh filter elements and results quoted are the mean of the three runs.

EXAMPLE 1

A carboxylated latex was prepared using butyl acrylate (56% of total monomers), methyl methacrylate (41%) and methacrylic acid (3%) with a mixed surfactant system comprising aryl polyether phosphate sodium salt (80% of surfactant) and aryl polyether (20%) such that the total level of surfactant was 4% of the total monomer by weight. A potassium persulphate initiator was used. A final solids content of 31% was obtained for the latex.

To this latex there was added, at a level of 3% relative to latex on a solids basis, the following stabilisers.

All were first made up as 20% wt/wt aqueous solutions.

(i) Nonyl phenol ethoxylate (50 mol ethoxy units)

(ii) Polyvinyl alcohol (PV(OH)), molecular weight 44,000.

(iii) Polyvinylpyrrolidone (PVP), molecular weight 300,000

(iv) Compound IV of formula I of the formula

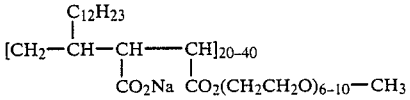

Each of the above four latices were then added to a 10% gelatino silver halide emulsion at 35° C. to give the total concentrations quoted above. Also prepared was a control in which no colloid stabiliser was added to the latex. Each solution was pumped through the above described apparatus, in which an initial back pressure of 3 psi was recorded. The time taken for the pressure to rise to 15 psi is tabulated. (IPSI is equivalent to 6894.76 Newtons/m$^2$).

| | Latex Additive | Time taken to reach 15 psi |
|---|---|---|
| (Control) | None | 20 seconds |
| (i) | Nonyl phenol ethoxylate | 40 seconds |
| (ii) | PV (OH) | 1 minute 15 seconds |
| (iii) | PVP | 2 minutes 45 seconds |
| (iv) | Compound IV | 9 minutes 40 seconds |

It can be seen that the latex/gel blend is inherently unstable and rapidly blocks filters, causing a very fast rise in pressure. Stabilisers (i), (ii) and (iii), well known as colloid stabilisers, improve the stability of the solution but a major improvement is obtained by using the compound (iv) as used in the present invention.

EXAMPLE 2

A latex was prepared from butyl acrylate, hydroxypropyl methacrylate and an arylphenol polyether phosphate sodium salt as surfactant according to B.P. 1333663. To this was added 4% by weight on a solids basis of the compound IV used in Example I. Mixtures of this latex with gelatino silver halide emulsion were prepared as in Example I.

Also a control containing no compound of formula I and a further control with a gelatino silver halide emulsion solution alone were prepared. The solutions were filtered and pumped through the above apparatus and the pressure increase (from an initial back pressure of 3 psi) is tabulated.

| Solution | Pressure (psi) after: 5 minutes | 10 minutes |
|---|---|---|
| gelatin silver halide emulsion alone | 3 | 4 |
| gelatin silver halide emulsion + latex but no additive | 40 | * |
| gelatin silver alide emulsion + latex + compound of formula IV | 5 | 6 |

*after 6 minutes the joints on the apparatus ruptured due to excessive pressure build up The addition of the compound of formula IV considerably reduced the tendency of the solution to fail catastrophically under shear.

EXAMPLE 3

A low contrast silver halide emulsion was prepared using the following proportions :

| | |
|---|---|
| Silver halide | 1000 g |
| Gelatin | 2600 g |
| Latex (solids) | 1100 g |

(i) with no added stabiliser
(ii) with added compound IV

Together with small quantities of sensitizing dye, surfactants and hardening agent to a total weight of 52600 g.

A formulation made up according to these proportions was coated using a cascade coating machine on polyethylene laminated paper base at a silver coating weight of 1.6 g/m$^2$. A supercoat layer was also coated to a weight of 2.3 g/m$^2$ of gelatin.

In line cartridge filters were used during the coating. These were polyolefin filters with a pore size of approximately 30 $\mu$m.

The filters were removed afterwards and washed. The filter used in (i) (no added stabiliser) was quite heavily contaminated by floculated material. The filter from (ii) by contrast was almost clean. This demonstrates the highly beneficial effect on shear stability of the compounds of formula I used in the present invention. A good quality coating was obtained, for which sensitometric and other details are obtained as shown below.

| | Dmax | LER (1) | speed at D 0.1 | Speed through safelight filter at D 0.1 | Gloss % (2) Black | White |
|---|---|---|---|---|---|---|
| a. control (no additive) | 1.84 | 1.01 | 2.15 | 0.63 | 73 | 96 |
| b. with compound | 1.82 | 1.04 | 2.16 | 0.64 | 76 | 96 |

-continued

| | Dmax | LER (1) | speed at D 0.1 | Speed through safelight filter at D 0.1 | Gloss % (2) Black | Gloss % (2) White |
|---|---|---|---|---|---|---|
| IV c. Stabilizer* only (no latex) | 1.82 | 1.05 | 2.16 | 0.60 | 66 | 96 |

*added at a level equivalent four times that in b (1) LER is a logarithmic measure of the exposure range of the material as defined in ISO Standard No. 6846.

(2) Gloss was measured on a Hunterlab D48D glossmeter at an angle of 60° on a sample of material which had been dish processed and allowed to dry at room temperature.

Base tint and image colour measurements were unaffected by the use of the stabilised latex. It can be seen from the above data that the compound IV has little sensitometric effect, but if used in the absence of latex the gloss of the black areas of a print is much reduced. No effect of incubating the coating (7 days at 46° C.) was noted except in the case of a coating with additive alone when an increase in speed was noted on exposure through a safelight filter, from 0.60 to 0.86, at a density of 0.01. Levels of compound IV up to 10% of the total weight of latex gave no significant alteration in the above characteristics.

EXAMPLE 4

A latex was prepared as used in the above Example 3 and stored for 5 months at ambient temperature. Physical tests showed that there was no change in the latex over this time: thus, particle size remained unchanged and there was no sedimentation or flocculation. In addition, the shear stabilisation remained excellent.

The latex was coated in a high contrast silver halide emulsion in a similar way to that described above at periods of 1 week, 1 month, and 2,3,4 and 5 months after preparation of the latex. The following maximum density speed and gloss figures were obtained.

| Time after preparation | D max | Gloss % Black | Gloss % White | LER |
|---|---|---|---|---|
| 1 week | 1.77 | 73 | 96 | 0.50 |
| 1 month | 1.79 | 72 | 97 | 0.49 |
| 2 months | 1.84 | 79 | 97 | 0.46 |
| 3 months | 1.80 | 74 | 97 | 0.47 |
| 4 months | 1.83 | 77 | 96 | 0.45 |

-continued

| Time after preparation | D max | Gloss % Black | Gloss % White | LER |
|---|---|---|---|---|
| 5 months | 1.79 | 79 | 96 | 0.47 |

As can be seen, there is no appreciable change in photographic properties or keeping the latex containing the compound IV.

We claim:

1. An aqueous photographic coating solution which comprises an gelatino silver halide emulsion and a synthetic polymer latex and which is characterised in that it also comprises a compound of the general formula I:

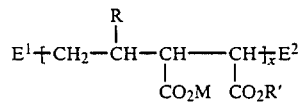

I wherein $E^1$ and $E^2$ represent the end groups of the polymer chain, R is a linear or branched alkyl group chain comprising 6 to 20 carbon atoms or is a phenyl group, R' is a polyether moiety of the formula

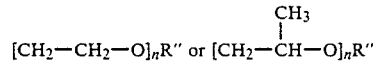

wherein R'' is a hydrogen atom, an alkyl group having 1 to 4 carbon atoms or $CH_3CO$— and n is 2 to 20, M is hydrogen or a monovalent cation, and x is 3 to 200, the ratio (by weight) of the compound of formula I to the synthetic polymer being from 0.1 to 50 of the compound of formula I to 100 of the synthetic polymer on a dry solids basis.

2. A coating solution according to claim 1 characterised in that in the compound of formula I R is an alkyl group having 10 to 18 carbon atoms.

3. A coating solution according to claim 1 characterised in that R' is $(CH_2CH_2O)_n CH_3$ and n is 3 to 15.

4. A coating solution according to claim 1 characterised in that in claim 1 x is 5 to 50.

5. A coating solution according to claim 1 characterised in that M is sodium or potassium.

6. A coating solution according to claim 1 characterised in that the synthetic polymer latex is a latex copolymer which comprises an alkyl acrylate, methyl methyacrylate and/or optionally a hydroxyalkyl acrylate or methacrylate and an acid monomer.

7. Photographic material which is characterised in that it has been prepared by coating a coating solution as claimed in claim 1 on a photographic base and drying the layers.

* * * * *